US005566755A

United States Patent [19]

Seidle et al.

[11] Patent Number: 5,566,755

[45] **Date of Patent: *Oct. 22, 1996**

[54] METHOD FOR RECOVERING METHANE FROM A SOLID CARBONACEOUS SUBTERRANEAN FORMATION

[75] Inventors: John P. Seidle; Dan Yee, both of Tulsa, Okla.; Rajen Puri, Aurora, Colo.

[73] Assignee: Amoco Corporation, Chicago, Ill.

[ * ] Notice: The term of this patent shall not extend beyond the expiration date of Pat. No. 5,388,641.

[21] Appl. No.: 387,258

[22] Filed: Feb. 13, 1995

Related U.S. Application Data

[63] Continuation-in-part of Ser. No. 147,111, Nov. 3, 1993, Pat. No. 5,388,642, and Ser. No. 147,125, Nov. 3, 1993, Pat. No. 5,388,643, and Ser. No. 147,122, Nov. 3, 1993, Pat. No. 5,388,641, and Ser. No. 147,121, Nov. 3, 1993, Pat. No. 5,388,640, and Ser. No. 146,920, Nov. 3, 1993, Pat. No. 5,388,645.

[51] Int. Cl.[6] ..... E21B 43/18

[52] U.S. Cl. ..... 166/263; 166/268

[58] Field of Search ..... 166/263, 266, 166/267, 268

[56] References Cited

U.S. PATENT DOCUMENTS

| | | | |
|---|---|---|---|
| 4,043,395 | 8/1977 | Every et al. | 166/263 |
| 4,283,089 | 8/1981 | Mazza et al. | 299/16 |
| 4,353,418 | 10/1982 | Hoekstra et al. | 166/267 X |
| 4,400,034 | 8/1983 | Chew | 299/5 |
| 4,446,921 | 5/1984 | Coenen et al. | 166/267 |
| 4,544,037 | 10/1985 | Terry | 166/369 |
| 4,756,367 | 7/1988 | Puri et al. | 166/263 |
| 4,883,122 | 11/1989 | Puri et al. | 166/263 |
| 5,014,785 | 5/1991 | Puri et al. | 166/263 |
| 5,014,788 | 5/1991 | Puri et al. | 166/308 |
| 5,085,274 | 2/1992 | Puri et al. | 166/252 |
| 5,099,921 | 3/1992 | Puri et al. | 166/266 |
| 5,133,406 | 7/1992 | Puri | 166/266 |
| 5,147,111 | 9/1992 | Montgomery | 299/16 |
| 5,388,640 | 2/1995 | Puri et al. | 166/263 |
| 5,388,641 | 2/1995 | Yee et al. | 166/263 |
| 5,388,642 | 2/1995 | Puri et al. | 166/266 |
| 5,388,643 | 2/1995 | Yee et al. | 166/266 |
| 5,388,645 | 2/1995 | Puri et al. | 166/268 |

OTHER PUBLICATIONS

Oil and Gas Journal, "Amoco Plans Test of Nitrogen Injection for Coalbed Methane", Oct. 28, 1991.

M. G. Zabetakis, et al., "Methane Control in United States Coal Mines–1972", U. S. Bureau of Mines, Information Circular 8600, pp. 8–16, (1973).

R. S. Metcalfe, D. Yee, J. P. Seidle, and R. Puri, "Review of Research Efforts in Coalbed Methane Recovery", SPE 23025, (1991).

M. D. Stevenson, W. V. Pinczewski and R. A. Downey, "Economic Evaluation of Nitrogen Injection for Coalseam Gas Recovery", SPE 26199, (1993).

(List continued on next page.)

*Primary Examiner*—George A. Suchfield

*Attorney, Agent, or Firm*—Charles P. Wakefield; Robert E. Sloat

[57] ABSTRACT

A method is disclosed for recovering methane from a solid carbonaceous subterranean formation having a production well in fluid communication with the formation and an injection well in fluid communication with the formation. In the method an oxygen-depleted effluent, produced by a cryogenic separator is injected into the formation through the injection well. A first methane-containing gaseous mixture is recovered from the formation through the production well during at least a portion of the time the oxygen-depleted effluent is being injected into the formation. The first methane-containing gaseous mixture has a first methane-desorbing gas volume percent. The injection of oxygen-depleted effluent is ceased and thereafter a second methane-containing gaseous mixture is recovered from the formation which has a second methane-desorbing gas volume percent which is less than the first methane-desorbing gas volume percent.

11 Claims, 4 Drawing Sheets

OTHER PUBLICATIONS

N. Ali, P. K. Singh, C. P. Peng, G. S. Shiralkar, Z. Moschovidis and W. L. Baack, "Injection Above–Parting–Pressure Waterflood Pilot, Valhall Field, Norway", SPE 22893, (1991).

R. Puri and D. Yee, "Enhanced Coalbed Methane Recovery", SPE 20732, (1990).

Brian Evison and R. E. Gilchrist, "New Developments in Nitrogen in the Oil Industry", SPE 24313, (1992).

Alan A. Reznik, Pramod K. Singh and William L. Foley, "An Analysis of the Effect of Carbon Dioxide Injection on the Recovery of In–Situ Methane from Bituminous Coal: An Experimental Simulation", SPE/DOE 10822, (1982).

Ralph W. Veatch, Jr., Zissis A. Mosachovidis and C. Robert Fast, "An Overview of Hydraulic Fracturing", *Recent Advances in Hydraulic Fracturing*, vol. 12, chapter 1, pp. 1–38, S.P.E. Monograph Series, (1989).

N. R. Warpinski and Michael Berry Smith, "Rock Mechanics and Fracture Geometry", *Recent Advances in Hydraulic Fracturing*, vol. 12, chapter 3, pp. 57–80, S.P.E. Monograph Series, (1989).

"Quarterly Review of Methane from CoalSeams Technology", *Gas Research Institute*, vol. 11, no. 1, p. 38, (1993).

Carl L. Schuster, "Detection Within the Wellbore of Seismic Signals Created by Hydraulic Fracturing", SPE 7448, (1978).

Amoco Production Company, Handout distributed at the International Coalbed Methane Symposium held in Birmingham, Alabama, May 17–21, 1993.

Application for Enhanced Recovery Nitrogen Injection Pilot and Approval of Aquifer Exemption, submitted to the Colorado Oil and Gas Conservation Commission, Aug. 30, 1990.

Durango Herald Newspaper Article, "Planners OK Amoco Facilities", dated May 15, 1991.

La Plata County Planning Commission, Colorado Planning Commission Information Session of Mar. 1991 dealing with Amoco's Planned Nitrogen Injection Pilot.

United States Environmental Protection Agency Region VIII, Transmittal Letter of Feb. 11, 1992 approving Nitrogen Injection Pilot and Associated Permits.

Nov. 9, 1990, Report of the Oil and Gas Conservation Commission of the State of Colorado.

Douglas M. Ruthven, "Principles of Adsorption and Adsorption Processes", A Wiley—Interscience Publication, Publisher, John Wiley & Sons, pp. 359–375, (1984).

Nigel McMullen and Miro Hojsak, "Reconsider Noncryogenic Systems for On–Site Nitrogen Generation", *Chemical Engineering Progress*, pp. 58–61, (1993).

B. D. Hughes and T. L. Logan, "How to Design a Coalbed Methane Well", *Petroleum Engineer International*, pp. 16–20, (May 1990).

Anthony E. DeGance, "Multicomponent High–Pressure Adsorption Equilibria on Carbon Substates: Theory and Data", *Fluid Phase Equilibria*, vol. 78, pp. 99–137, Elsevier Science Publishers B. V., Amsterdam, (1992).

S. Harpalani and U. M. Pariti, "Study of Coal Sorption Isotherms Using a Multicomponent Gas Mixture", a paper presented at the 1993 International Coalbed Methane Symposium, University of Alabama/Tuscaloosa, (May 17–21, 1993).

Paul F. Fulton, "A Laboratory Investigation of Enhanced Recovery of Methane from Coal by Carbon Dioxide Injection", SPE/DOE 8930, (1980).

Alan A. Reznik, et al., "Enhanced Recovery of In–Situ Methane by Carbon–Dioxide Injection: An Experimental Feasibility Study", a report by the Chemical and Petroleum Engineering Department, University of Pittsburgh, for the U.S. Department of Energy, Office fo Fossil Energy, Morgantown Energy Technology Center, DOE/MC/14262–1732 (DE85003352), (May 1982).

Dan Yee, et al., "Gas Sorption on Coal and Measurement of Gas Content", *Hydrocarbons from Coal*, Chap. 9, pp. 203–218, The American Assoc. of Petroleum Geologists, Tulsa, Oklahoma, (1993).

L. E. Arri, et al., "Modeling Coalbed Methane Production with Binary Gas Sorption", SPE 24363, (1992).

METHOD FOR RECOVERING METHANE FROM A SOLID CARBONACEOUS SUBTERRANEAN FORMATION

RELATED APPLICATIONS

This application is a continuation-in-part of U.S. patent applications, Ser. No. 08/147,111, now U.S. Pat. No. 5,388,642; Ser. No. 08/147,125, now U.S. Pat. No. 5,388,643; Ser. No. 08/147,122, now U.S. Pat. No. 5,388,641; Ser. No. 08/147,121, now U.S. Pat. No. 5,388,640; Ser. No. 08/146,920, now U.S. Pat. No. 5,388,645, all filed Nov. 3, 1993.

FIELD OF THE INVENTION

This invention generally relates to a method for increasing the production of methane-containing gaseous mixtures from solid carbonaceous subterranean formations. The invention more particularly relates to methods for improving the methane recovery rate from a solid carbonaceous subterranean formation by injecting an inert methane-desorbing gas into the formation.

BACKGROUND OF THE INVENTION

It is believed that methane is produced during the conversion of peat to coal. The conversion is believed to be a result of naturally occurring thermal and biogenic processes. Because of the mutual attraction between the carbonaceous matrix of coal and the methane molecules, a large amount of methane can remain trapped in-situ as gas adhered to the carbonaceous products formed by the thermal and biogenic processes. In addition to methane, lesser amounts of other compounds such as water, nitrogen, carbon dioxide, and heavier hydrocarbons, and sometimes small amounts of other fluids such as argon and oxygen, can be found within the carbonaceous matrix of the formation. The gaseous fluids which are produced from coal formations collectively are often referred to as "coalbed methane." Coalbed methane typically comprises more than about 90 to 95 volume percent methane. The reserves of such coalbed methane in the United States and around the world are huge. Most of these reserves are found in coal beds, but significant reserves may be found in gas shales and other solid carbonaceous subterranean formations which are also believed to have resulted from the action of thermal and biogenic processes on decaying organic matter.

Methane is the primary component of natural gas, a widely used fuel source. Coalbed methane is now produced from coal seams for use as a fuel. Typically, a wellbore is drilled which penetrates one or more coal seams. The wellbore is utilized to recover coalbed methane from the seam or seams. The pressure difference between a coal seam and the wellbore provides the driving force for flowing coalbed methane to and out of the wellbore. Reduction of pressure in the coal seam as coalbed methane is produced increases desorption of methane from the carbonaceous matrix of the formation, but, at the same time, deprives the system of the driving force necessary to flow coalbed methane to the wellbore. Consequently, this method loses its effectiveness over time for producing recoverable coalbed methane reserves. It is generally believed that this method is only capable of economically producing about 35 to 70% of the methane contained in a coal seam.

An improved method for producing coalbed methane is disclosed in U.S. Pat. No. 5,014,785 to Purl, et al. In this process, a methane-desorbing gas such as an inert gas is injected into a solid carbonaceous subterranean formation through at least one injection well, with a methane-containing gas recovered from at least one production well. The desorbing gas, preferably nitrogen, mitigates depletion of pressure within the formation and is believed to desorb methane from the carbonaceous matrix of the formation by decreasing the methane partial pressure within the formation. This method is effective for increasing both the total amount and rate of methane production from a solid carbonaceous subterranean formation such as a coal seam. Present indications are that the rate of methane production can be increased and that the total amount of methane recovered can be increased substantially, to possibly 80% or more of the methane contained in the formation.

As will be demonstrated by an Example contained herein, long-term injection of an inert gas into a formation may result in the production of a methane-containing gas having an inert gas fraction that generally increases in volume percent with time. This result may be undesirable as it may be necessary to lessen the concentration of injected inert gas in the produced methane-containing mixture before the mixture can be transferred into a natural gas pipeline or otherwise utilized.

What is needed is an improved process for the recovery of methane from solid carbonaceous subterranean formations that can provide a methane-containing gas that contains as little of the injected inert gas as possible to mitigate the costs associated with removing the injected gas from the produced methane-containing gaseous mixture.

As used herein, the following terms shall have the following meanings:

(a) "Air" refers to any gaseous mixture containing at least 15 volume percent oxygen and at least 60 volume percent nitrogen. "Air" is preferably the atmospheric mixture of gases found at the well site and contains between about 20 and 22 volume percent oxygen and between about 78 and 80 volume percent nitrogen.

(b) "Cleats" or "cleat system" is the natural system of fractures within a solid carbonaceous subterranean formation.

(c) "Adsorbate" is that portion of a gaseous mixture which is preferentially adsorbed by a bed of adsorptive material during the adsorptive portion of a pressure swing adsorption separator's cycle.

(d) "Formation paring pressure" and "parting pressure" mean the pressure needed to open a formation and propagate an induced fracture through the formation.

(e) "Fracture half-length" is the distance, measured along the fracture, from the wellbore to the fracture tip.

(f) "Recovering" means a controlled collection and/or disposition of a gas, such as storing the gas in a tank or distributing the gas through a pipeline. "Recovering" specifically excludes venting the gas into the atmosphere.

(g) "Reservoir pressure" means the pressure of a productive formation near a well during shut-in of that well. The reservoir pressure of the formation may change over time as inert methane-desorbing gas is injected into the formation.

(h) "Solid carbonaceous subterranean formation" refers to any substantially solid, methane-containing material located below the surface of the earth. It is believed that these methane-containing materials are produced by the thermal and biogenic degradation of organic matter. Solid carbonaceous subterranean formations include but are not limited to coalbeds and other carbonaceous formations such as shales.

(i) "Well spacing" or "spacing" is the straight-line distance between the individual wellbores of a production well and an injection well. The distance is measured from where the wellbores intercept the formation of interest.

(j) "Preferentially adsorbing," "preferentially adsorbs," and "preferential adsorption" refer to processes that alter the relative proportions of the components of a gaseous fluid. The processes fractionate a mixture of gases by equilibrium separation, kinetic separation, steric separation, and any other process or combinations of processes which within a bed of material would selectively fractionate a mixture of gases into an oxygen-depleted fraction and an oxygen-enriched fraction.

(k) "Raffinate" refers to that portion of the gas injected into a bed of adsorptive material which is not preferentially adsorbed by the bed of adsorptive material.

(l) "Standard initial production rate" as used herein refers to the actual or predicted methane-containing gas production rate of a production well immediately prior to flowing a methane-desorbing gas through the well to increase its production rate. A standard initial production rate may be established, for example, by allowing a well to operate as a pressure depletion well for a relatively short period of time just prior to inert gas injection. The standard initial production rate can then be calculated by averaging the production rate over the period of pressure depletion operation. If this method is used, the well preferably will have been operated long enough that the transient variations in production rates do not exceed about 25% the average production rate. Preferably, the "standard initial production rate" is determined by maintaining constant operating conditions, such as operating at a constant bottom hole flowing pressure with little or no fluid level. Alternatively, a "standard initial production rate" may be calculated based on reservoir parameters, as discussed in detail herein, or as otherwise would be calculated by one of ordinary skill in the art.

(m) "Inert methane-desorbing gas" as used herein refers to any gas or gaseous mixture that contains greater than fifty volume percent of a relatively inert gas or gases. A relatively inert gas is a gas that promotes the desorption of methane from a solid carbonaceous subterranean formation without being strongly adsorbed to the solid organic material present in the formation or otherwise chemically reacting with the solid organic material to any significant extent. Examples of relatively inert gases include nitrogen, argon, air, helium and the like, as well as mixtures of these gases. An example of a strongly desorbed gas not considered to be a relatively inert gas is carbon dioxide.

(n) "Reacted" as used herein refers to any reaction of an oxygen-enriched stream with a second process stream. Examples of such reactions include but are not limited to combustion, as well as other chemical reactions including reforming processes such as the steam reforming of methane to synthesis gas, oxidative chemical processes such as the conversion of ethylene to ethylene oxide, and oxidative coupling processes as described herein.

(o) "Oxidizable reactant" as used herein means any organic or inorganic reactant that can undergo chemical reaction with oxygen. For example, oxidizable reactants include materials which can be chemically combined with oxygen, that can be dehydrogenated by the action of oxygen, or that otherwise contain an element whose valence state is increased in a positive direction by interaction with oxygen.

(p) "Organic reactant" as used herein means any carbon and hydrogen-containing compound regardless of the presence of heteroatoms such as nitrogen, oxygen and sulfur. Examples include but are not limited to methane and other hydrocarbons whether used as combustion fuels or starting materials for conversion to other organic products.

(q) "Inorganic reactant" as used herein means any reactant which does not contain both carbon and hydrogen.

(r) "Methane-desorbing gas volume percent" refers to the volume percent of the inert methane-desorbing gas found in the produced methane-containing gaseous mixture at a given point in time that is attributable to the injection of the methane-desorbing gas. It should be noted that if a multi-component inert methane-desorbing gas is used, some components of the gas may appear in the produced gas before others or in varying ratios. In this case, the methane-desorbing gas volume percent refers to the sum of all inert gas components actually appearing in the produced gas. If the formation produces any naturally-occurring inert gas components identical to one or more components injected into the formation, the naturally-occurring portion of the components should be subtracted from the detected amount to determine the methane-desorbing gas volume percent attributable to inert gas injection.

(s) "Formation location" refers to a location within a solid carbonaceous subterranean formation into which an inert methane-desorbing gas can be injected to increase methane-containing gas production from a production well in fluid communication with the point of gas injection. Inert gas typically is injected from the surface into such a location through one or more injection wells bored into the formation.

(t) "Enhanced production rate" for a given well is any rate greater than the standard initial production rate which is caused by the injection of an inert methane-desorbing gas into the formation. In most cases, it is believed that the enhanced production rate of the well will remain greater than the standard initial production rate of the well for a substantial period of time following the suspension of inert methane-desorbing gas injection or a reduction of inert gas injection rate, thereby retaining some of the advantages of enhanced production at a reduced methane-desorbing gas volume percent. Where the term "fully-enhanced production rate" is used, the term refers to the maximum steady-state production rate caused by continuously injecting the inert methane-desorbing gas into the formation at a given injection rate.

(u) "Methane-derived reactant" means a compound created directly from a methane-containing feedstock, a compound whose synthesis employs an intermediate compound created from a methane-containing process stream, or a non-inert contaminating compound co-produced with natural gas. Examples of methane-derived reactants include but are not limited to synthesis gas obtained by reforming methane, methanol or dimethyl ether when formed by the direct or step-wise reaction of synthesis gas over a catalyst, mixtures containing $C_2$ and greater hydrocarbons and/or heteroatom-containing variants thereof obtained from a process such as a Fischer-Tropsch catalytic hydrogenation of methane-derived synthesis gas over a catalyst, and the common natural gas contaminant hydrogen sulfide.

SUMMARY OF THE INVENTION

The general object of this invention is to provide a method for recovering methane from solid carbonaceous subterranean formations.

One aspect of the invention exploits our discovery that the inert gas fraction present in a methane-containing gas produced by injecting an inert methane-desorbing gas into a solid carbonaceous subterranean formation can be reduced on a volume percent basis by temporarily suspending injection of the inert gas.

The inert gas content of a produced methane-containing mixture is of significant economic importance. The presence of inert gas in the produced gaseous mixture reduces the methane content and therefore the fuel value of a given volume of the produced gaseous mixture. Additionally, in some cases, it will be necessary to reduce the amount of inert gas in the produced gaseous mixture so that the mixture can be used in a chemical process or transferred to a natural gas pipeline. Temporarily suspending inert gas injection to reduce the inert gas volume percent present in the produced methane-containing gaseous mixture therefore can reduce operating costs by reducing the need to remove inert gas from the produced mixture; or by reducing the amount of inert gas which must be removed from the produced mixture.

It is believed that in some cases, a beneficial effect similar to that obtained by suspending inert methane-desorbing gas injection may be obtained simply by reducing the injection rate of the inert gas into the formation. Additional benefits can be obtained by staggering the suspension or reduction of inert gas injection into multiple wells so that the output from the wells may be mixed to produce a mixture containing a lower average volume percent of inert gas than could otherwise be obtained from wells in which changes in injection flow are not staggered with respect to time.

A second aspect of the invention takes advantage of our discovery that injection of an inert methane-desorbing gas into a solid carbonaceous subterranean formation can yield increased gas production rates after injection of the methane-desorbing gas has been terminated. This period of post-injection elevated production, hereafter referred to as the "tail" period, provides for the recovery of a large quantity of gas at production rates greater than the standard initial production rate of the well, thereby eliminating the need for and costs associated with operating inert gas production and injection equipment during the tail period.

Numerous other advantages and features of the present invention will become readily apparent from the following detailed description of the invention, the embodiments described therein, the claims, and the accompanying drawings.

DETAILED DESCRIPTION OF THE INVENTION

Figure 1:
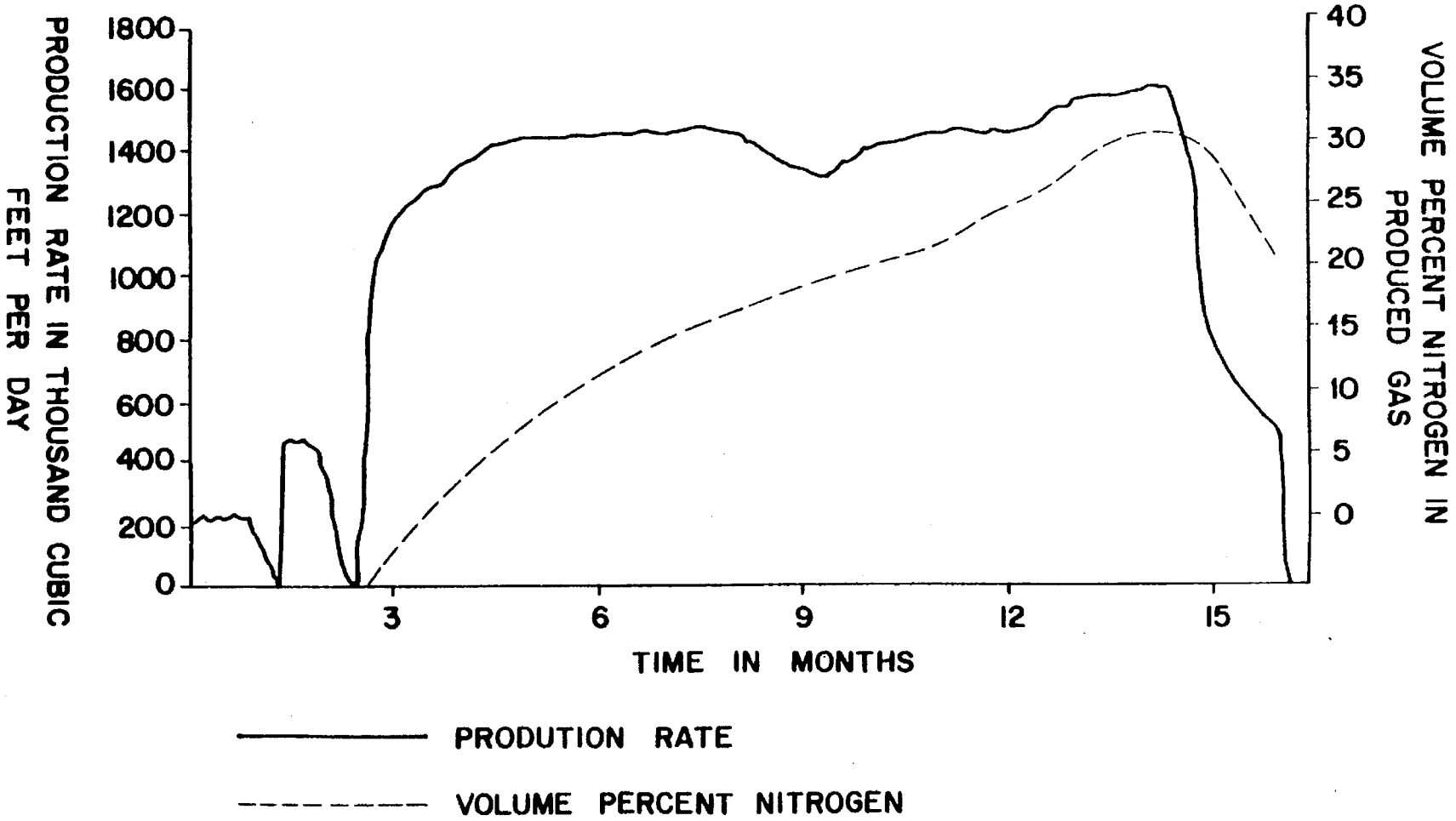
FIG. 1 is a graph of the rate of total fluids recovered over time from a pilot field which utilized oxygen-depleted air to enhance the recovery of methane from a coalbed. The total fluids recovered primarily contain methane and nitrogen, with a small volume percentage of water. The graph also shows the volume percent of nitrogen over time in the total fluids recovered.

Inert methane-desorbing gases suitable for use in the invention include any gas or gaseous mixture that contains greater than fifty volume percent of a relatively inert gas or gases. A relatively inert gas is a gas that promotes the desorption of methane from a solid carbonaceous subterranean formation without being significantly adsorbed to the solid organic material present in the formation or otherwise reacting with the solid organic material. Examples of relatively inert gases include nitrogen, argon, air, helium and the like, as well as mixtures of these gases. Flue gas and other gaseous mixtures of carbon dioxide and nitrogen which contain greater than 50% by volume nitrogen are examples of inert methane-desorbing gases suitable for use in the invention.

Although atmospheric air is a cheap and plentiful inert methane-desorbing gas suitable for use in the invention, nitrogen-rich gases having a greater volume percent of nitrogen than is present in air are the preferred inert methane-desorbing gases. A preferred feedstock for producing nitrogen rich-gases is atmospheric air, although other gaseous mixtures of nitrogen and less reactive gases may be used if available. Such other mixtures may be produced by using or mixing gases obtained from processes such as the cryogenic upgrading of nitrogen-containing low BTU natural gas.

Many techniques for producing nitrogen-enriched gaseous mixtures from nitrogen-containing gaseous mixtures, such as air, are known in the art. Three suitable techniques are membrane separation, pressure swing adsorption separation and cryogenic separation. It should be noted that each of these methods can also be used to produce other suitable inert methane-desorbing gases and mixtures thereof from feedstocks other than atmospheric air if such feedstocks are sufficiently available. When the separation systems are used to produce nitrogen-enriched gaseous mixtures from air, the nitrogen-rich fraction is referred to as an oxygen-depleted effluent.

Membrane Separation

Any membrane separator capable of separating oxygen from nitrogen can be used in this invention. A general discussion on membrane systems, which includes the transport mechanisms within membranes, physical structure of membranes, and membrane system configurations, is contained in "Kirk-Othmer Encyclopedia of Chemical Technology" 3rd Ed., Volume 15, pages 92–131 (1981), which is incorporated herein by reference. Examples of membrane separators which can be utilized are membrane separators sold by Niject Services Co., hereinafter referred to as "NIJECT", located in Tulsa, Oklahoma, and Generon Systems, hereinafter referred to as "GENERON", located in Houston, Tex.

Membrane separator systems useful in this invention typically include a compressor section and a membrane section. The compressor section compresses inlet gaseous fluid, which preferably contains at least 60 volume percent nitrogen and at least 15 volume percent oxygen, to a suitable pressure. The most preferred inlet gaseous fluid is air found at the production site. The pressurized gaseous fluid is then passed through the membrane section of the membrane separator system. The membrane sections of both the "GENERON" separator system and the "NIJECT" separator system are equipped with hollow fiber bundles which produce an oxygen-depleted effluent fraction and an oxygen-enriched effluent fraction.

The hollow fiber bundles should preferentially separate the nitrogen from the other components of the inlet gaseous fluid, such as oxygen. Several flow regimes which take advantage of the selective permeability of the hollow fiber bundles can be utilized. For example, the inlet gaseous fluid can be passed through the hollow fibers or it can be injected under pressure into the region surrounding the fibers. In the "NIJECT" separator, for example, compressed air on the outside of the hollow fibers provides the driving energy which causes oxygen, carbon dioxide and water to permeate into the interior of the hollow fibers, while oxygen-depleted effluent remains outside of the fibers. The oxygen-depleted effluent leaves the unit at a pressure of about 50 p.s.i.g. or higher, generally at least about 100 p.s.i.g.

In the "GENERON" separator, for example, compressed air is passed through the inside of the hollow fibers. A pressure differential between the inside and outside of the fiber provides the driving energy which causes the oxygen-enriched air to pass through the walls of the hollow fibers from the high pressure region to the lower pressure region. Oxygen-depleted effluent is maintained inside the hollow fibers and leaves the separator at an elevated pressure of about 50 p.s.i.g. or higher, preferably at least about 100 p.s.i.g. Although the subject invention is not to be so limited, it is believed that the costs associated with compression of the oxygen-depleted effluent, such as the cost of compression equipment and the cost of the energy used to drive the compression equipment, will typically be in excess of 50% of the total cost required to produce methane using the invention. Therefore, it is preferable to use a membrane separator system which, for a given oxygen-depleted effluent through-put, minimizes the pressure drop across the membrane separator. This will reduce the total cost of producing and compressing oxygen-depleted effluent for use in enhancing the production of methane from a solid carbonaceous subterranean formation.

The membrane separator can be operated at an inlet pressure of about to about 250 p.s.i.g., preferably about 100 to about 200 p.s.i.g., and within the proper operating parameters to reduce the oxygen content of the oxygen-depleted effluent to the desired volume ratio of nitrogen to oxygen. In general, the concentration of oxygen in the oxygen-depleted effluent is dependent on the through-put of oxygen-depleted effluent through the membrane separator. For example, for a membrane system, the higher the inlet pressure to the membrane section of the membrane separator system, the higher the through-put, and the more oxygen in the oxygen-depleted effluent and the less oxygen in the oxygen-enriched effluent. The lower the inlet pressure to the membrane section of the membrane separator system, the lower the through-put, and the lower the oxygen content of the oxygen-depleted effluent. This relationship between inlet pressure and oxygen content of the effluent is for a system which is operating within the designed operating range of the membrane system with all major variables other than the inlet pressure to the membrane section of the membrane separator system being held constant and which utilizes a membrane which is more permeable to oxygen than nitrogen.

The flow rate of the oxygen-depleted effluent produced must be high enough to provide an adequate flow while still providing for adequate fractionation of the gaseous fluid into its components. Where flammability in the injection wellbore due to the presence of oxygen in the oxygen-depleted effluent is an important consideration, the membrane separator preferably should be operated to provide an oxygen-depleted effluent having a nitrogen-to-oxygen volume ratio of about 9:1 to about 99:1. It is more preferable to operate the membrane separator to provide an oxygen-depleted effluent having from about 2 to 8% by volume oxygen.

Where flammability in the injection wellbore due to the presence of oxygen in the oxygen-depleted effluent is not an important consideration, the membrane separator is preferably operated to provide a relatively high flow of oxygen-depleted effluent having up to 94.9 volume percent nitrogen. Although commercial membrane separators are typically configured to provide oxygen-depleted effluent having between 95 and 99.1 volume percent nitrogen, it is believed that reconfiguring a membrane separator system to provide an oxygen-depleted effluent having 94.9 or less volume percent nitrogen will greatly increase the quantity of oxygen-depleted effluent produced from the separator as compared to standard commercial separators. This will greatly reduce the processing costs for producing oxygen-depleted effluent using a membrane separator system.

For example, a typical membrane separator processing gaseous fluid having about 80 volume percent nitrogen and about 20 volume percent oxygen and which is producing an oxygen-depleted effluent having 99 or greater volume percent nitrogen provides about thirty-five moles of oxygen-depleted effluent for every one hundred moles of gaseous fluid processed by the separator. Decreasing the nitrogen volume percent in the oxygen-depleted effluent to from about 90% to 94.9% will provide from about seventy to about sixty moles of oxygen-depleted effluent for every one hundred moles of gaseous fluid processed by the separator. Therefore, the cost of producing oxygen-depleted effluent can be substantially reduced by decreasing the volume percent nitrogen in the oxygen-depleted effluent.

Additional information concerning the use of membrane separators in enhanced methane recovery processes can be found in co-pending U.S. patent application Ser. No. 08/147,111, Attorney Docket No. 33,314, which is hereby incorporated by reference.

Pressure Swing Adsorption Separation

During the operation of a pressure swing adsorption separator, a gaseous fluid preferably containing at least 60 volume percent nitrogen and at least 15 volume percent oxygen is injected into a bed of adsorptive material to establish a total pressure on the bed of adsorptive material. This is commonly referred to as the "adsorption portion" of a pressure swing adsorption cycle. The injection of gaseous fluid is continued until a desired saturation of the bed of material is achieved. The desired adsorptive saturation of the bed of material can be determined by routine experimentation. While the gaseous fluid is being injected into the bed of adsorptive material, an oxygen-depleted effluent (raffinate) is withdrawn from the separator. A total pressure is maintained on the bed of adsorptive material while raffinate is withdrawn. Maintaining pressure on the bed will ensure that the injected gaseous fluid is efficiently fractionated into an oxygen-depleted fraction and an oxygen-enriched fraction.

Once the desired adsorptive saturation of the bed is obtained, the material's adsorptive capacity can be regenerated by reducing the total pressure on the bed of material. The reduction of the pressure on the bed is commonly referred to as the "desorption portion" of a pressure swing adsorption cycle. A desorbed gaseous effluent, which is enriched in oxygen, is released from the bed of adsorptive material while the separator is operating in the desorption portion of its cycle. This desorbed gaseous effluent is referred to as an "adsorbate." The adsorbate is released from the bed of adsorptive material due to the reduction in total pressure which occurs within the bed during the desorptive portion of a pressure swing adsorption separator's cycle. If desired, the bed of material may be purged before the adsorption portion of the cycle is repeated to maximize adsorbate removal from the bed.

In general, the pressure utilized during the adsorption portion of the cycle and the differential pressure utilized by the adsorptive separator are selected so as to optimize the separation of the nitrogen from oxygen. The differential pressure utilized by the adsorption separator is the difference between the pressure utilized during the adsorption portion of the cycle and the pressure utilized during the desorption portion of the cycle. In general, the higher the pressure utilized, the more gas which can be adsorbed by the bed of adsorptive material. For a given system, the faster the removal of oxygen-depleted effluent from the system, the higher the oxygen content in the oxygen-depleted effluent.

The cost of pressurizing the injected gaseous fluid is important to consider when determining what pressures to be used with the separator. The flow rate of the oxygen-depleted effluent removed during the adsorption portion of the cycle must be high enough to provide an adequate flow but low enough to allow for adequate separation of the gaseous fluid into its components. Where flammability in the injection wellbore due to the presence of oxygen in the oxygen-depleted effluent is an important consideration, the pressure swing adsorption separator preferably should be operated to provide an oxygen-depleted effluent having a nitrogen-to-oxygen volume ratio of about 9:1 to about 99:1. It is more preferable to operate the pressure swing adsorption separator to provide an oxygen-depleted effluent having from about 2 to 8% by volume oxygen.

Where flammability in the injection wellbore due to the presence of oxygen in the oxygen-depleted effluent is not an important consideration, the pressure swing adsorption separator is preferably operated to provide a relatively high flow of oxygen-depleted effluent having up to 94.9 volume percent nitrogen. Although commercial pressure swing adsorption separators are typically configured to provide oxygen-depleted effluent having between 95 and 99.1 volume percent nitrogen, it is believed that reconfiguring a pressure swing adsorption separator system to provide an oxygen-depleted effluent having 94.9 or less volume percent nitrogen will greatly increase the quantity of oxygen-depleted effluent produced from the separator as compared to standard commercial separators. This will greatly reduce the processing costs for producing oxygen-depleted effluent using a pressure swing adsorption separator system. For example, it is believed that decreasing the nitrogen volume percent in the oxygen-depleted effluent from 95% to 93% may result in a 15% increase in the flow rate of oxygen-depleted effluent for a given pressure swing adsorption separator.

The types of materials that can be utilized in a pressure swing adsorption separator include any carbonaceous, alumina-based, silica-based, zeolitic, and other metallic-based materials that can preferentially adsorb a given component of a gaseous mixture. Each of these general classes has numerous variations characterized by their material composition, method of activation, and the selectivity of adsorption they exhibit. Examples of materials which can be utilized for the bed of adsorptive material are zeolites, having sodium alumina silicate compositions such as 4A-type zeolite and "RS-10" (a zeolite molecular sieve manufactured by Union Carbide Corporation), carbon molecular sieves, activated carbon and other carbonaceous beds of material. In the preferred embodiment of the invention, a bed of adsorptive material is used which preferentially adsorbs oxygen over nitrogen. Also, in the preferred embodiment of the invention, more than one bed of adsorptive material is utilized so that one bed of material may be operating in the adsorption portion of its cycle while another bed of material is operating in the desorption portion of its cycle or is being purged. This method of operation will provide a continuous supply of oxygen-depleted effluent.

In the preferred embodiment of the invention, a carbon molecular sieve material is utilized for the bed of adsorptive material. Examples of separators which utilize carbon molecular sieve materials are the "NCX" Series of pressure swing adsorption separator systems, which are manufactured by Generon Systems, a joint venture of Dow Chemical Company and the BOC Group. Vacuum desorption is preferably utilized to purge the bed of adsorptive material prior to restarting the adsorptive portion of the cycle. The pressure swing adsorption separator commonly operates between a pressure of about 4 atmospheres during the adsorption portion of the cycle and about 0.1 atmospheres during the desorption portion of the cycle.

Additional information concerning the use of pressure swing adsorption separators in enhanced methane recovery processes can be found in copending U.S. patent application Ser. No. 08/147,125, Attorney Docket No. 33,316, which is hereby incorporated by reference.

Cryogenic Separation

A third method for preparing a nitrogen-rich gas from air is cryogenic separation. In this process, air is first liquefied and then distilled into an oxygen enriched fraction and a nitrogen enriched fraction. While cryogenic separation routinely can produce nitrogen fractions having less than 0.01 volume percent oxygen contained therein and oxygen fractions containing 70 volume percent or more oxygen, the process is extremely energy-intensive and therefore expensive. Because the presence of a few volume percent oxygen in a nitrogen-rich gas is not believed to be detrimental when such a stream is used to enhance methane recovery from a methane-containing formation, the relatively pure nitrogen fraction typically produced by cryogenic separation will not ordinarily be cost-justifiable.

Other methods for producing suitable inert gas mixtures will be known to those skilled in the art. Matters to be considered when choosing an inert methane-desorbing gas include the availability of the gas at or near the injection site, the cost to produce the gas, the quantity of gas to be injected, the volume of methane displaced from the solid methane-containing material by a given volume of the inert gas, and the cost and ease of separating the gas from the mixture of methane and inert gas collected from the formation.

Injection of the Inert Methane-Desorbing Gas

The inert methane-desorbing gas is injected into the solid carbonaceous subterranean formation at a pressure higher than the reservoir pressure. Preferably, the inert methane-desorbing gas is injected at a pressure of from about 500 p.s.i.g. to about 1500 p.s.i.g. above the reservoir pressure of the formation. If the injection pressure is below or equal to the reservoir pressure, the inert methane-desorbing gas typically cannot be injected because it cannot overcome the reservoir pressure of the formation. The inert methane-desorbing gas is injected preferably at a pressure below the formation parting pressure of the solid carbonaceous subterranean formation. If the injection pressure is too high and the formation extensively fractures, injected inert methane-desorbing gas may be lost and less methane may be produced.

However, based on studies of other types of reservoirs, it is believed that inert methane-desorbing gas may be injected into the formation at pressures above the formation parting pressure as long as induced fractures do not extend from an injection well to a production well. In fact, injection above formation parting pressure may be required in order to achieve sufficient injection and/or recovery rates to make the process economical or, in other cases, may be desired to achieve improved financial results when it can be done without sacrificing overall performance. Preferably, the fracture half-length of the induced fractures within the formation is less than from about 20% to about 30% of the spacing between an injection well and a production well. Also, preferably, the induced fractures should be maintained within the formation.

Parameters important to the recovery of methane, such as fracture half-length, fracture azimuth, and height growth can be determined using formation modeling techniques which are known in the art. Examples of the techniques are discussed in John L. Gidley, et al., "Recent Advances in Hydraulic Fracturing," Volume 12, *Society of Petroleum Engineers Monograph Series,* 1989, pp. 25–29 and pp. 76–77; and Schuster, C. L., "Detection Within the Wellbore of Seismic Signals Created by Hydraulic Fracturing", paper SPE 7448 presented at the 1978 Society of Petroleum Engineers' Annual Technical Conference and Exhibition, Houston, Tex., October 1–3. Alternatively, the fracture half-length and impact of its orientation can be assessed using a combination of pressure transient analysis and reservoir flow modeling such as described in SPE 22893, "Injection Above-Fracture-Parting Pressure Pilot, Valhal Field, Norway," by N. All et al., 69th Annual Technical Conference and Exhibition of the Society of Petroleum Engineers, Dallas, Tex., Oct. 6–9, 1991. While it should be noted that the above reference describes a method for enhancing oil recovery by injection of water above fracture-parting-pressure, it is believed that the methods and techniques discussed in SPE 22893 can be adapted to enhance the recovery of methane from a solid carbonaceous subterranean formation.

In general, the deeper the solid carbonaceous subterranean formation, the higher the pressure necessary to inject the inert methane-desorbing gas into the formation. Typically, an injection pressure of from about 400 to 2000 p.s.i.g. will be sufficient to inject inert methane-desorbing gas into a majority of the formations from which it is desirable to recover methane using the invention.

The inert methane-desorbing gas is injected into the solid carbonaceous subterranean formation through an injection well in fluid communication with the formation. Preferably, the injection well penetrates the methane-containing formation, but the injection well need not penetrate the formation as long as fluid communication exists between the formation and the injection well. The injection of inert methane-desorbing gas may be either continuous or discontinuous. The injection pressure may be maintained constant or varied.

Inert methane-desorbing gas injection rates useful in the invention can be determined empirically. Typical injection rates can range from about 300,000 to 1,500,000 standard cubic feet per day with the higher rates being preferred.

Recovery of Methane from the Formation

A fluid comprising methane is recovered from a production well in fluid communication with the formation. As with the injection well, the production well preferably penetrates the methane-containing formation, but the production well need not penetrate the formation as long as fluid communication exists between the formation and the production well. The production well or wells are operated in accordance with conventional coalbed methane recovery wells. It may be desirable to minimize the backpressure on a production well during recovery of fluids comprising methane through that production well. The reduction of back-pressure on the production well will assist the movement of the fluid, comprising methane, from the formation to the wellbore.

Preferably, a production well is operated so that the pressure in the production well at a wellbore location adjacent the methane producing formation is less than the initial reservoir pressure of the formation. The wellbore location adjacent the methane producing formation is within the wellbore, not the formation. The initial reservoir pressure is the reservoir pressure near the production well of interest at a time before the initial injection of inert methane-desorbing gas into the formation. The reservoir pressure may increase during the injection of inert methane-desorbing gas, but it is believed that the pressure in the production well near the formation preferably should be maintained less than the initial reservoir pressure. This will enhance the movement of fluid from the formation to the wellbore. Most preferably, the pressure in a production well at a wellbore location adjacent the methane producing formation should be less than about 400 p.s.i.g.

In some instances back-pressure on a production well's wellbore may be preferable, for example, when it is desirable to maintain a higher reservoir pressure to minimize the influx of water into the formation from surrounding aquifers. Such an influx of water into the formation could reduce the methane recovery rate and also complicate the operation of a production well.

Another situation where it can be preferable to maintain back-pressure on a production well's wellbore is when there is concern over the precipitation and/or condensation of solids and/or liquids within the formation near the wellbore or in the wellbore itself. The precipitation and/or condensation of solids or liquids in or near the wellbore could reduce the methane recovery rate from a production well. Examples of materials which may precipitate or condense out near the wellbore and present a problem are occluded oils, such as waxy crudes, it is believed that a higher pressure in the production well's wellbore at a location adjacent to the formation will minimize such precipitation and/or condensation of solids or liquids in or near the wellbore. Therefore, if precipitation and condensation in the wellbore are a problem, it may be preferable to increase the pressure in the production well's wellbore to a value as high as practicable.

Preferably, a solid carbonaceous subterranean formation, as utilized in the invention, will have more than one injection well and more than one production well in fluid communication with the formation.

The timing and magnitude of the increase in the rate of methane recovery from a production well will depend on many factors including, for example, well spacing, thickness of the solid carbonaceous subterranean formation, cleat porosity, injection pressure and injection rate, injected inert methane-desorbing gas composition, sorbed gas composition, reservoir pressure, and cumulative production of methane prior to injection of inert methane-desorbing gas.

When the foregoing parameters are generally held constant, a smaller spacing between an injection well and a production well will result in a faster observable production well response (both an increase in the recovery rate of methane and a shorter time before injected inert methane-desorbing gas appears at a production well) than the response which occurs with an injection well and a production well separated by a larger spacing. When spacing the wells, the desirability of a fast increase in the rate of methane production must be balanced against other factors such as earlier nitrogen breakthrough when utilizing a reduced well spacing and the quantity of inert methane-desorbing gas utilized to desorb the methane from the formation for any given spacing.

If the spacing between the wellbores is too small, the injected gas will pass through the formation to the production well without being efficiently utilized to desorb methane from within the carbonaceous matrix.

In most cases, injection and production wells will be spaced 100 to 10,000 feet apart, with 1000 to 5000 feet apart being typical. It is believed that the effect of injected gas on production rate at a distant production well generally decreases with increased spacing between the injection and production well.

Preferably, the methane-containing gaseous mixture recovered from the well typically will contain at least 65 percent methane by volume, with a substantial portion of the remaining volume percent being the methane-desorbing gas injected into the formation. Relative fractions of methane, oxygen, nitrogen and other gases contained in the produced mixture will vary with time due to methane depletion and the varying transit times through the formation for different gases. In the early stages of well operation, one should not be surprised if the recovered gas closely resembles the in situ composition of coalbed methane. After continued operation, significant amounts of the injected inert gas can be expected in the recovered gas.

The fully-enhanced production rate of a methane-containing gaseous mixture produced during inert gas injection is expected to exceed a standard initial production rate of a given well by a factor of about 1.1 to about 5 times, or in some cases, 10 times or more.

Where actual production rate data is unavailable, a "standard initial production rate" may be calculated based on various reservoir parameters. Such calculations are well-known in the art, and can yield production estimates based on parameters such as the results of well pressure tests or the results of core analyses. Examples of such calculations can be found in the 1959 Edition of the "Handbook of Natural Gas Engineering" published by the McGraw-Hill Book Company, Inc., of New York, N.Y. While such estimates should prove to be accurate within a factor of two or so, it is preferred to determine the "standard initial production rate" by actually measuring produced gas.

If desired, the methane produced in accordance with this invention can be separated from co-produced gases, such as nitrogen or mixtures of nitrogen and any other gas or gases which may have been injected or produced from the solid carbonaceous subterranean formation. Such co-produced produced gases will, of course, include any gases that occur naturally in solid carbonaceous subterranean formations together with the methane. As discussed earlier, these naturally-occurring gases together with the methane are commonly referred to as coalbed methane. These naturally occurring gases can include, for example, hydrogen sulfide, carbon dioxide, ethane, propane, butane, and heavier hydrocarbons in lesser amounts. If desired, the methane produced in accordance with this invention can be blended with methane from other sources which contain relatively fewer impurities.

Termination of Injection of Inert Methane-Desorbing Gas

Injection of the inert methane-desorbing gas may be terminated at any time after an enhanced production rate has been established. Typically, injection will be terminated when the amount of inert gas present in the produced methane-containing mixture exceeds a particular composition limit, or because the injection equipment is believed to be more useful at another site. For example, the injection may be terminated when the methane-desorbing gas volume percent rises to a point where the removal of inert methane-desorbing gas from the produced methane-containing mixture is not economically justified.

After termination of inert gas injection, two heretofore unexpected events have been observed. First, although the total production rate declines, the production rate remains enhanced above the standard initial production rate of the well for a significant period of time. Additionally, where inert gas has been found in the methane-containing gas withdrawn from the production well, the volume percent of inert gas in the mixture decreases with time. These effects are illustrated by the following Examples.

Oxygen-Enriched Stream

In a further aspect of the invention, an oxygen-enriched stream, which results from the fractionation of air into an oxygen-depleted stream or effluent and an oxygen-enriched stream, is utilized to provide more favorable process economics for an enhanced methane recovery process than might otherwise be obtained. Common to each process described with respect to this aspect of the invention is 1) the generation of an oxygen-depleted stream used to enhance the recovery of methane from a solid carbonaceous subterranean formation and 2) the utilization of an oxygen-enriched stream produced as a byproduct of generating the oxygen-depleted stream in some type of oxidative process. The methane-containing gas produced by practicing this invention can be used for on-site purposes such as fueling power plants, providing feedstock to chemical plants, or operating blast furnaces.

The oxygen-depleted and oxygen-enriched process streams required for practicing the invention can be produced by any technique suitable for physically separating atmospheric air or a similar gas into oxygen-enriched and oxygen-depleted fractions. Three suitable separation techniques are membrane separation, pressure swing adsorption separation, and cryogenic separation. These separation techniques are described above.

The gas to be fractionated typically will be atmospheric air or a similar gas mixture, although other gaseous mixtures of oxygen and less reactive, preferably inert gases, may be used if available. Such other mixtures may be produced by using or mixing gases obtained from processes such as the cryogenic upgrading of nitrogen-containing low BTU natural gas. The following discussion describes atmospheric air as the gas to be fractionated, but is not intended to limit the gas to be fractionated to atmospheric air.

The oxygen-enriched gas stream resulting from the production of the oxygen-depleted injection fluid can be utilized in a variety of ways. For example, the oxygen-enriched stream can be reacted with a stream containing one or more organic compounds. The reaction can be combustion or another type of chemical reaction. In most cases, reacted organic compounds will be methane or derived from a methane feedstock, although the oxygen-enriched feedstock can be used advantageously in other chemical or combustion processes, particularly if an integrated chemical or industrial complex is located at or near the production well.

Use of an oxygen-enriched stream containing 25 volume per unit or more oxygen in conjunction with other process streams containing organic compounds will often require optimization of the concentrations of the oxygen, nitrogen and other gases contained in the process streams. For example, if blends of oxygen-enriched air are reacted with methane-containing nitrogen or nitrogen and carbon dioxide, it frequently will be desirable to control the volume of the oxygen-enriched stream combined with the methane in order to control the ratio of methane to oxygen in the resulting mixture. This will permit an optimized combustion if the mixture is burned. Alternatively, if the mixture is used as a feedstock for a petrochemical process such as synthesis gas formation as discussed below, the methane to oxygen ratio will be optimized for that purpose. Control over the amount of oxygen-enriched air which is used can be particularly important because the concentration of gases such as carbon dioxide and nitrogen in the methane may not be constant with time.

The invention is particularly well-suited to processes requiring the onsite generation of power or heat. For example, calculations show that a representative mixture withdrawn from a production well in accordance with the present invention containing 16 weight percent nitrogen and 84 weight percent methane may be burned with a 40 volume percent oxygen-enriched process-derived stream to yield the same quantity of heat as the combustion of air and pure methane. Combining the production well's methane/nitrogen stream with the process' oxygen-rich stream in this manner reduces costs by eliminating the need to remove nitrogen from the produced natural gas stream before combustion. The heat produced can be used for a variety of purposes by employing heat exchange means which are well-known in the art.

Combustion of a nitrogen/methane stream with the oxygen-enriched stream is particularly well-suited to the on-site production of electricity. This is especially true in countries or regions which have a fairly well-developed electrical distribution system but do not have a pipeline system for the transportation of natural gas. In a case such as this, the produced nitrogen/methane stream can be burned with the oxygen-enriched stream in natural gas-fired electrical generation equipment such as a turbine-driven generator. Such a plant is capable of consuming large quantities of the identified gas streams and converting the resulting energy to an easily distributed form, thereby avoiding the need to remove nitrogen from the produced gas and as well as eliminating the need for a pipeline system.

The oxygen-enriched process stream also can be used advantageously in a wide variety of non-combustive chemical reactions. The stream is most advantageously used in conjunction with methane-requiring processes located near the production well. One oxygen-utilizing process particularly well suited to the invention is the oxidative coupling of methane to higher molecular weight hydrocarbons useful as chemical reactants or fuels such as gasoline.

A typical oxidative coupling process reacts an oxygen-containing gas such as air with methane vapors over an oxidative coupling "contact" material or catalyst to "couple" together methane molecules and previously "coupled" hydrocarbons to form higher molecular weight hydrocarbons. A wide variety of contact materials useful for oxidative coupling reactions are well-known in the art and typically comprise a mixture of various metals often including rare earths in a solid form known to be stable under the oxidative coupling reaction conditions. One representative contact material is disclosed in U.S. Pat. No. 5,053,578, the disclosure of which is hereby incorporated by reference. This material contains a Group IA metal, a Group IIB metal and a metal selected from the group consisting of aluminium, silicon, titanium, zinc, zirconium, cadmium and tin.

The oxidative coupling reaction can be carried out under a wide variety of operating conditions. Representative conditions for the reaction include gas hourly space velocities between 100 and 20,000 $hrs^{-1}$, methane to oxygen ratios of about 2:1 to 10:1, pressures ranging from subambient to 10 atmospheres or more, and temperatures ranging from about 400° C. to about 1,000° C. It should be noted that temperatures above about 1,000° C. are not preferred as thermal reactions begin to overwhelm the oxidative coupling reaction at these temperatures.

The nitrogen-containing methane feedstock produced from an enhanced methane recovery project, as described herein, may be used "as is" as a source of methane because the presence of additional nitrogen is not believed to seriously effect the oxidative coupling reaction. Additionally, the oxygen-rich stream may be advantageously used to provide a source of oxygen for the oxidative coupling reaction. Such a process is economically favorable when compared to a typical methane/air oxidative coupling process because the increased oxygen content of the oxygen-enriched stream reduces the bulk gas volume required to be handled in the process. Reducing the volume lowers the energy and compressor costs from those required for oxidative coupling processes employing air as a source of oxygen when pressures above about two atmospheres are employed as less nitrogen needs to be compressed and transported through the process. Of course, where a methane and nitrogen mixture is used as an oxidative coupling feedstock at these relatively higher pressures, compressors and related physical plant requirements need to be sized to accommodate the additional gas volume attributable to the nitrogen contained in the feedstock.

The oxygen-enriched stream created in the inventive process also can be used in a variety of other chemical and petrochemical processes requiring a source of oxygen. In these cases, use of the oxygen-enriched stream reduces or eliminates capital costs that would otherwise be required for an oxygen production plant. This in turn can render many economically unfavorable chemical processes economically favorable.

Examples of processes that can benefit from the availability of an oxygen-rich stream in accordance with the present invention include:

(1) steel-making operations in which oxygen is used both to promote fuel efficiency and remove contaminants such as carbon and sulfur by oxidizing these contaminants typically present in liquefied iron;

(2) non-ferrous metals production applications where an oxygen-enriched gas is used to save time and money in the reverberatory smelting of metals such as copper, lead, antimony and zinc; and (3) chemical oxidation processes such as the catalytic oxidation of ethylene to ethylene oxide or ethylene glycol or the production of acetic acid, as well as the liquid phase oxidation or oxychlorination of any suitable organic feed compound.

The invention also is well-suited to the production of synthesis gas, which can be converted to chemicals such as methanol, acetic acid or dimethyl ether by conventional and well-known chemical processes. In these applications, synthesis gas can be produced by reacting the oxygen-enriched stream with a methane-containing stream by any of several well-known processes such as steam reforming. The synthesis gas stream then may be used to form organic compounds which contain 2 or more carbon atoms in a process such as the Fischer-Tropsch process wherein synthesis gas is catalytically converted over any of a number of well-known catalysts to produce a wide variety of mixtures of $C_2$ to $C_{10}$ organic compounds such as hydrocarbons and alcohols.

Yet another use for an oxygen-enriched stream generated in accordance with the present invention is to improve the capacity of hydrogen sulfide-removing processes such as those employed in the Claus process. As is known in the art, natural gas can contain appreciable quantities of hydrogen sulfide, or $H_2S$, gas. The highly corrosive gas must be removed from natural gas prior to distribution of the natural gas, and is typically removed from natural gas by scrubbing with a solution of an amine in water, such as by scrubbing with monoethanol or diethanol amine in a packed column or tray tower. The $H_2S$ typically then is converted to elemental sulfur through a process known as the Claus process.

In the Claus process, $H_2S$ gas is converted to elemental sulfur in accordance with the following equations:

$$H_2S+3/2O_2 \rightarrow SO_2+H_2O \quad \text{(I)}$$

$$2H_2S+SO_2 \rightarrow 3S+2H_2O \quad \text{(II)}$$

$$3H_2S+3/2O_2 \rightarrow 3S+3H_2O \text{ (Net reaction)} \quad \text{(III)}$$

As can be seen from Equation (I), the oxygen-enriched stream of the present invention can be advantageously used to promote the oxidation of hydrogen sulfide gas.

It is believed that applying an oxygen-enriched stream having up to about 30 weight percent oxygen in accordance with the present invention to an existing Claus plant can increase the capacity of the plant up to about 25 percent without substantial plant modification. Additional capacity could be gained by specifically designing a Claus reactor to employ an oxygen-enriched stream which contains more than about 30 weight percent oxygen. Using the oxygen-enriched stream of this invention in this manner provides an opportunity for substantial capital cost savings where an oxygen-enriched stream is available.

Additional information concerning the use of an oxygen-enriched stream, produced by an enhanced methane recovery project, can be found in co-pending U.S. patent application Ser. No. 08/146,920, Attorney Docket No. 33,344, which is hereby incorporated by reference.

Example 1

A pilot plant test of this invention was carried out in a coalbed methane field containing two production wells. Each of the production wells was producing a methane-containing gas for about 4 years prior to this test from a twenty-foot thick coal seam located at an approximate depth of 2,700 feet below the surface. One of the production wells was removed from service to be used as an injection well, and three additional injection wells were provided by drilling into the same coal seam at three additional locations. The five wells can be visualized as a "five spot" on a domino covering an 80-acre square area with the injection wells surrounding the production well (i.e. the injection wells were located at the corners of the "five spot" about 1800' from each other).

Inlet air was compressed to about 140 psig by two air compressors operated in parallel and passed through a skid mounted 10'×10'×20' "NIJECT" membrane separation unit equipped with hollow fiber bundles. The compressed air on the outside of the fibers provided the driving energy for oxygen, $CO_2$ and water vapor to permeate the hollow fibers, while a oxygen-depleted, nitrogen-rich stream passed outside of the fiber. About 540,000 cubic feet of oxygen-enriched air containing about 40% by volume oxygen exited the unit each day. Nitrogen-rich gas containing between about 4 to 5 volume percent oxygen exited the membrane separation unit at about the inlet pressure. This nitrogen-rich gas was compressed to approximately 1000 psig in a reciprocating electric injection compressor and injected into the four injection wells at a rate of about 300,000 cubic feet per day per well for several months.

Within one week after injection began, the volume of gas produced from the production well increased from the measured standard initial production rate of 200,000 cubic feet of gas per day to a fully-enhanced production rate of between 1.2 to 1.5 million cubic feet of gas per day. Injection of the nitrogen-rich gas continued for about one year. During the one-year injection period, the fully-enhanced production remained relatively constant. Initially the well produced very little nitrogen, but over time the nitrogen content increased steadily to about 35 volume percent. FIG. 1 illustrates a smoothed average of total well production and percent nitrogen found in the produced methane-containing gaseous mixture before, during and after injection of the nitrogen-rich gas.

The results of the pilot test as shown in the FIG. 1 demonstrate that it is possible to at least double the rate of methane recovery from a solid carbonaceous subterranean formation, such as a coal seam, by injecting nitrogen-rich gas into the formation. The doubled rate of methane recovery can be maintained for at least twelve months. It was further shown that a recovery rate four times the pre-injection recovery rate could be maintained for at least eleven months, and five times the pre-injection rate could be maintained for at least five months.

Based on the pilot test it is believed that the methane recovery rate can be increased to twice the pre-injection recovery rate within ninety days of commencing injection of nitrogen-rich gas, preferably within thirty days of commencing injection of nitrogen-rich gas. It is further believed that the methane recovery rate can be increased to five times its pre-injection value within two months of commencing injection.

Furthermore, after injection of the inert gas was terminated, the production rate declined sharply at first, but then began to fall off more slowly. Over the forty-day "tail" period after injection was terminated, well production surprisingly never decreased below about 400,000 standard cubic feet per day, about a factor of 2 greater than the standard initial production rate of the well. Furthermore, during this forty-day period, the volume percent of nitrogen found in the produced gas unexpectedly decreased from an initial value of about 35 volume percent to a final value of about 25 volume percent.

The inventive process exploits these surprising findings. Prior to the discovery of these phenomena, one of ordinary skill might conclude that injection and production should be terminated when the inert gas present in the recovered methane-containing mixture increased to an undesired volume percent. To the contrary, our Example 1 shows that enhanced production levels of a gas having a continually decreasing inert gas fraction are available for a substantial period of time following the termination of inert gas injection. Thus, a preferred process is to continue to recover the methane-containing product after injection of the inert gas is terminated, rather than to simply cap the well and move on to another site as might otherwise be done.

It is believed that both the rate of decline in recovery rate and rate of decline in inert gas concentration during the post-injection period just described will vary for any given injection and production well system. In addition to the basic geological parameters affecting natural gas production generally, factors believed to affect the decline in recovery rate and inert gas concentration include the duration and magnitude of inert gas injected, the type or types of inert gas injected, and amount of formation methane depletion. Variability in the foregoing factors may also in some cases result in a time delay between suspension of injection and observed effect at the production well. The process just described can be operated in a cyclical fashion to provide additional operating advantages as illustrated by Example 2, below. Also, the process can provide additional advantages when applied to a system of several wells as illustrated by Example 4, below.

Example 2

Figure 2:
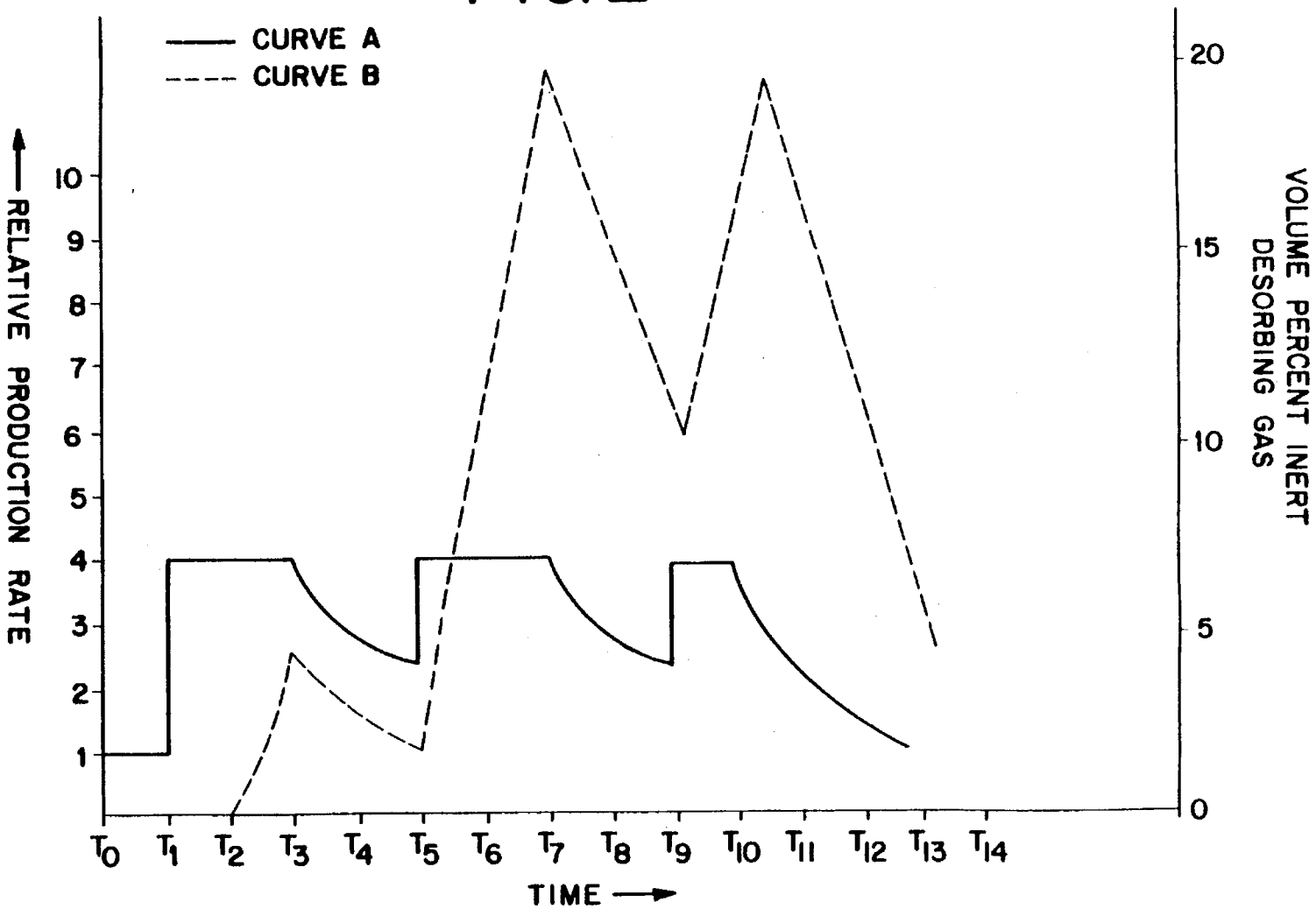
FIG. 2 is a graph of total gas production and inert methane-desorbing gas volume percent as a function of time for a well operated in accordance with the present invention.

In this Example, the production rate of a single hypothetical natural gas well is stimulated by the injection of an inert methane-desorbing gas such as a gaseous mixture containing about 95 volume percent nitrogen. As shown on FIG. 2, the well produces at a standard initial production rate of 1 volume per unit time from a time T0 to a time T1 as indicated on Curve A. At time T1, the inert methane-desorbing gas is injected into a formation location in fluid communication with the producing well, causing the production rate of the well to increase to a fully-enhanced rate of 4 volumes per unit time from time T1 to time T3. Starting at time T2, the inert gas begins to appear in the produced gas, as indicated on Curve B, reaching a value of about 5 volume percent at time T3. At time T3, inert gas injection equipment becomes unavailable, causing inert gas injection to be suspended until time T5. During the time period from T3 to T5, the production rate of the well decreases to 3 volumes per unit time and the volume percent of inert gas present in the produced gas decreases to about 2.5 volume percent.

At time T5, inert gas injection resumes. The production rate of the well returns to about 4 volumes per unit time, and the volume percent of inert gas in the produced gas increases slowly until an operational upper limit of twenty volume percent is reached. When the limit is reached, inert gas injection is once again suspended, allowing production to continue during a period of declining inert volume percent in the produced gas running from time T7 through time T9. At time T9, injection resumes to increase the production rate until the operational inert gas volume percent limit of 20 percent is reached again at time T10, at which time injection is again suspended.

This Example illustrates that suspending inert gas injection during the time period from T7 to T9 permits recovery from the production well to continue beyond the point in time at which the inert gas content operational limit is first reached. This result is only possible because of our unexpected discovery that the inert gas volume percent of the produced mixture steadily declines during a period of suspended injection when a well is operated in accordance with the present invention. It should also be noted that even though inert gas injection is suspended between times T3 and T5 and again between times T7 and T9, the production rate of the well remains enhanced above the standard initial production rate of 1 volume per unit time.

Additional advantages accrue when multiple wells are operated in a cyclical, "out-of-phase" mode in accordance with the present invention. This type of operation is demonstrated in Example 3, below.

Example 3

In this Example, the production rate of two hypothetical natural gas wells is stimulated by the injection of an inert methane-desorbing gas such as atmospheric air. A first well produces a methane-containing gaseous mixture as indicated by Curves A and B on FIG. 3. Curves A and B are identical to those already presented in Example 2 and shown in FIG. 2.

Figure 3:
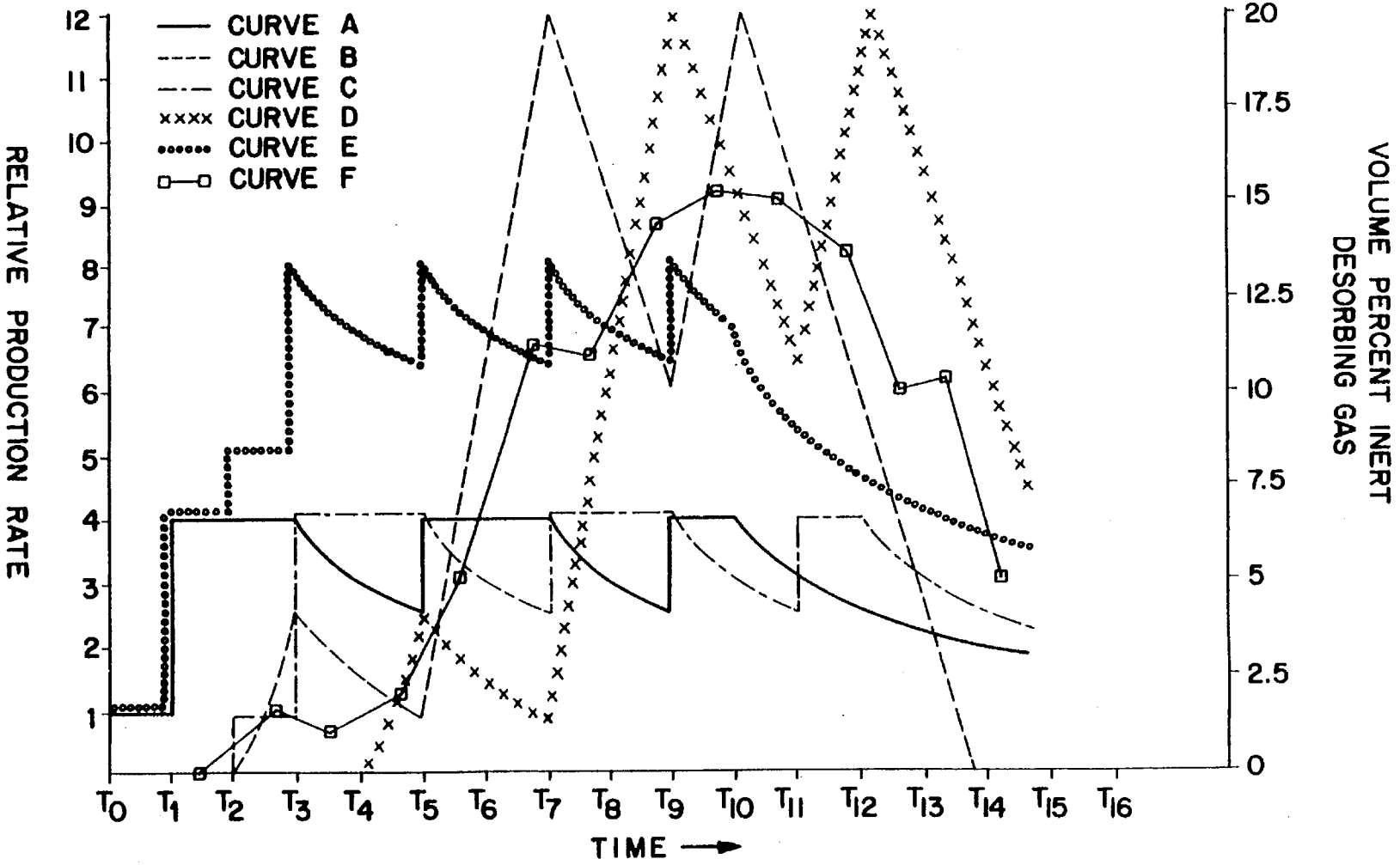
FIG. 3 is a graph of individual and composite total gas production and inert methane-desorbing gas volume percent as a function of time for a pair of wells operated in accordance with the present invention.

A second well having an identical operating history to the first well but placed in operation two time units later than the first well produces a second methane-containing gaseous mixture at a rate and inert gas volume percent as indicated by Curves C and D on FIG. 3, respectively.

The production of the first and second wells is combined and is transferred to a pipeline system that cannot accept a methane-containing mixture containing greater than 18 volume percent of inert methane-desorbing gas. The combined production of the first and second wells and the inert gas volume percent of the combined produced gases are indicated by Curves E and F, respectively.

As can be seen by comparing Curves B, D and E, even though both the first and second wells produce methane-containing mixtures having as much as 20 volume percent of inert gas, operating both wells in a cyclical process in which the inert gas maxima occur at different times, or "out-of-phase," permits the individual productions to be combined to yield continuous production at inert gas volume percent levels below the maximum values exhibited by the individual wells. In this particular Example, the individual wells can operate in a fully-enhanced production mode until the produced inert gas volume percent from individual wells reaches 20 volume percent without exceeding a combined volume percent of about 15 percent. This eliminates the need for processing the combined well productions to reduce the inert gas volume percent below the specified 18 volume percent upper limit.

It should also be noted that overall production remains relatively high, as the summed production rate between times T5 and T10 always includes at least one well operating at the fully-enhanced production rate that results from continuous injection of inert gas into the formation.

The multiple well processes such as the "out-of-phase" process just described can include any number of wells as long as the inert gas volume percent maxima exhibited in the gaseous mixtures recovered from two or more of the wells occur at different points in time. The maximum benefit will, of course, be obtained where pairs of wells exhibit production histories similar to sine waves having a phase difference of 180 degrees. In other words, where minimizing inert gas volume percent in produced gas is a primary concern, pairs of wells should be operated so that gas produced from one well of the pair reaches its maximum value of inert gas volume percent at the same time the gas produced from the other well of the pair reaches a minimum value of inert gas volume percent.

Although it is somewhat counter-intuitive, the foregoing Example illustrates that in some cases, an overall production advantage may be gained by delaying the injection of inert gas into one well of a system. This is the case when delaying injection into a well starts that well on a recovery cycle that will place the well "out-of-phase" with respect to one or more wells whose outputs are to be combined. Although total recovery during a start-up period may be less under this regime, such delay may make it possible to avoid the need for post-recovery inert gas removal if the averaging of the "out-of-phase" well outputs can lower the cumulative inert gas volume percent below an operational upper limit.

Additionally, it is believed that many of the inert gas volume percent reduction advantages obtained by suspending inert gas injection as shown in the foregoing Examples may be obtained by merely reducing the flow of injected inert gas. If the inert gas injection rate is reduced, the magnitude of the effect at the production well is expected to be proportional to the magnitude of the injection rate reduction, although results are expected to vary with reservoir depletion and other operating history as well as with the type of injected gas and the injectability of the reservoir. To achieve a practical effect, it may be necessary in many cases to reduce the injection rate by a factor of at least two.

Additional information concerning the control of the methane-desorbing gas volume percent in a produced methane-containing gaseous mixture can be found in co-pending U.S. patent application Ser. No. 08/147,122, Attorney Docket No. 33,342, which is hereby incorporated by reference.

Example 4

Figure 4:
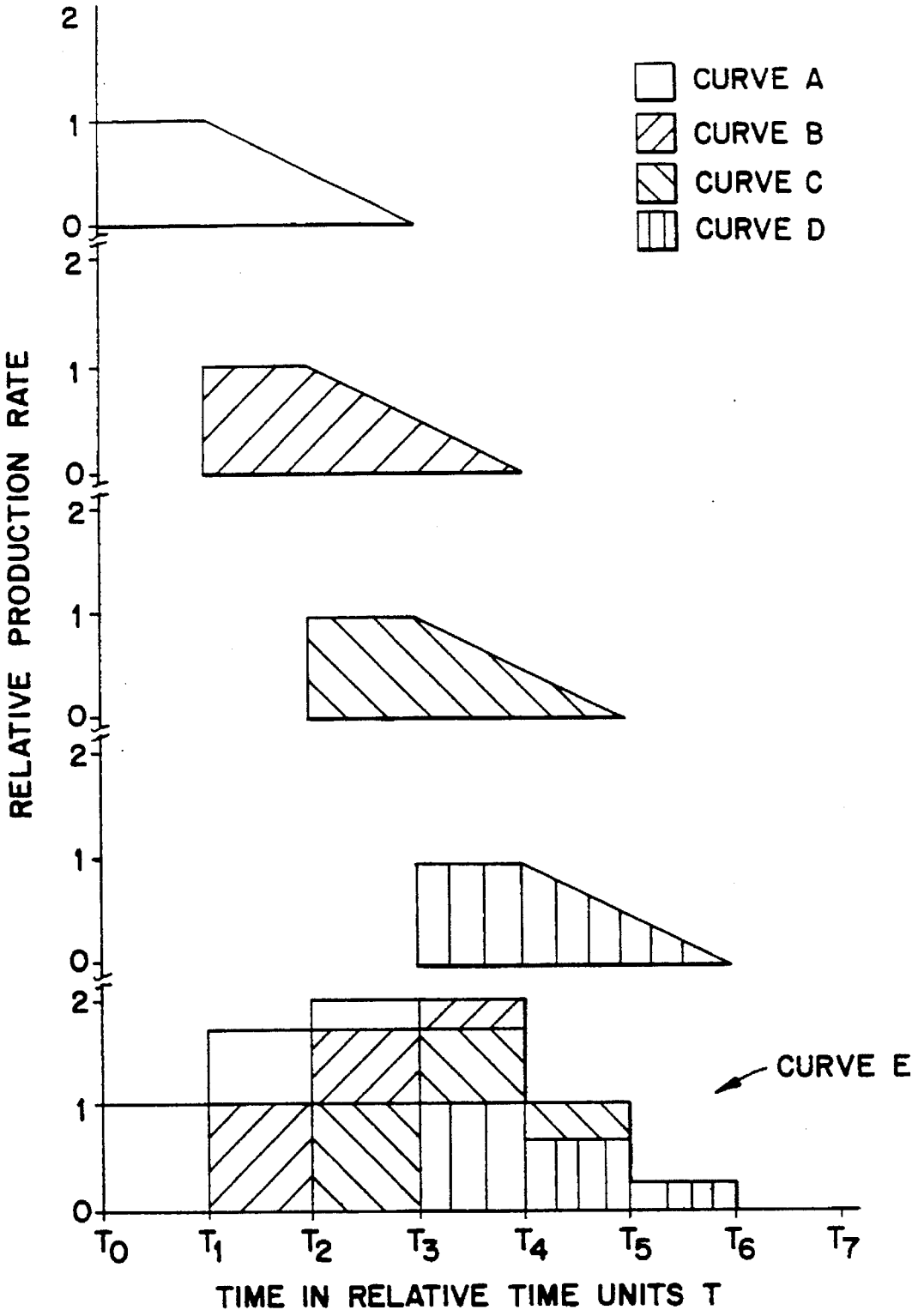
FIG. 4 is a plot illustrating how the production of several wells may be improved by serially operating the wells in accordance with the present invention.

In this Example, a hypothetical module of four injection and production well systems is operated in accordance with the present invention, with the rate and quantity of production from each well and for the total production of the four production wells graphically represented on FIG. 4. Each of the four production wells is located within the same formation or different formations, with each production well assumed to be associated with a formation location into which an inert gas can be injected to enhance methane-containing gas production from the associated production well.

Curve A illustrates the total gas production of a first well operated during a period of inert gas injection from time TO to time T1, followed thereafter by a tail period of declining enhanced recovery in the absence of inert gas injection from time T1 until time T3. Curve B illustrates the total gas production of a second well operated during a period of inert gas injection from time T1 to time T2, followed thereafter by a tail period of declining enhanced recovery in the absence of inert gas injection from time T2 until time T4. Curve C illustrates the total gas production of a third well operated during a period of inert gas injection from time T2 to time T3, followed thereafter by a period of enhanced recovery in the absence of inert gas injection from time T3 until time T5. Curve D illustrates the total gas production of a fourth well operated during a period of inert gas injection from time T3 to time T4, followed thereafter by a tail period of declining enhanced recovery in the absence of inert gas injection from time T4 until time T6.

For ease of explanation, the production rate obtained from each well during inert gas injection is assumed to be constant and equal. For each Curve A through E on FIG. 4, the vertical axis represents relative production rate while the horizontal axis represents time units. The area under each curve is therefore proportional to the total quantity of methane-containing gas produced from each respective well. As can be seen by comparing Curves A through D, an inert gas is continuously injected into a formation or formations from time T0 to time T4, but gas is only injected into a single well at any given time.

Curve E is a histographic representation of the summed methane-containing gas produced by the four wells averaged over intervals equal to one time unit. The various shadings on Curve E are the same as those used on Curves A through D and indicate the portion of the total production contributed by Curves A through D. As can be seen by comparing Curve E to Curves A through D, total gas production obtained by injecting inert gas serially into the four injection and production well systems exceeds that obtainable by continuous injection into a single injection and production well system by a substantial amount.

The serial injection method just described is particularly advantageous because it permits a single inert gas production and injection apparatus to be used to provide for natural gas production in excess of that obtained if the single inert gas production and injection unit remained in service at a single well system for an identical period of time. Although total production from the inventive method is likely to be somewhat less than is obtained by simultaneously injecting into a plurality of well systems, operating costs incurred from the serial injection method are substantially diminished by the use of only a single inert gas production and injection apparatus. Furthermore, because the relative volume percent of inert gas is believed to decrease with time throughout the tail period of a well, the output of wells undergoing injection and in tail periods can be combined to yield a gaseous mixture having a relatively lower inert gas volume percent, thereby facilitating downstream use and/or reducing processing costs of the mixture, further lessening or delaying capital costs.

Other variations of the serial injection method just described can provide production advantages. The benefits of post-injection enhanced recovery can be obtained in any situation in which the number of operating well systems exceeds the number of available inert gas production and injection units and in which the injection of an inert methane-desorbing gas provides for enhanced post-injection recovery in one or more wells. In these cases, maximum production will be obtained by continuously injecting into as many injection and production well systems as possible while simultaneously recovering methane-containing gases from other well systems that are producing gas in the post-injection or tail portion of the recovery process. Where multiple gas production and injection units are available and several wells are simultaneously operated in the post-injection enhanced recovery phase, production and injection units should be placed in service on the post-injection units exhibiting the lowest post-injection recovery when inert gas units from other well systems entering the tail portion of the recovery process become available.

A more detailed discussion relating to the recovery of methane from a solid carbonaceous subterranean formation during the tail period can be found in co-pending U.S. patent application Ser. No. 08/147,121, Attorney Docket No. 33,341, which is hereby incorporated by reference.

It should be appreciated that various other embodiments of the invention will be apparent to those skilled in the art through modification or substitution without departing from the spirit and scope of the invention as defined in the following claims.

We claim:

1. A method for recovering methane from a solid carbonaceous subterranean formation having a production well in fluid communication with the formation and an injection well in fluid communication with the formation, the method comprising the steps of:

a) processing a gaseous fluid containing at least 60 volume percent nitrogen and at least 15 volume percent oxygen through a cryogenic separator to produce an oxygen-depleted effluent;

b) injecting the oxygen-depleted effluent into the formation through the injection well at a rate of from about 300,000 standard cubic feet per day to about 1,500,000 standard cubic feet per day, the injection well having a well spacing of from about 1,000 feet to about 5,000 feet from the production well;

c) thereafter suspending injection of the oxygen-depleted effluent into the formation;

d) recovering a first methane-containing gaseous mixture from the formation through the production well during at least a portion of injection step b), the first methane-containing gaseous mixture having a first methane-desorbing gas volume percent; and e) recovering a second methane-containing gaseous mixture from the formation through the production well after performing suspending step c), the second methane-containing gaseous mixture having a second methane-desorbing gas volume percent less than the first methane-desorbing gas volume percent.

2. The method of claim 1, wherein the first methane-desorbing gas volume percent is determined at a point in time immediately preceding performance of the suspending step.

3. The method of claim 1, wherein the second methane-containing gaseous mixture is recovered in the absence of oxygen-depleted effluent injection.

4. The method of claim 2, wherein the second methane-containing gaseous mixture is recovered in the absence of oxygen-depleted effluent injection.

5. The method of claim 1, wherein the gaseous fluid processed in step a) is air.

6. The method of claim 1, wherein the oxygen-depleted effluent injected during step b) contains greater than about 80 volume percent nitrogen.

7. The method of claim 1, wherein the methane-containing gaseous mixture is recovered from the production well at a standard initial production rate prior to the injection of oxygen-depleted effluent in step b), and wherein the first methane-containing gaseous mixture is recovered at a rate greater than 1.1 times the standard initial production rate during at least a portion of the injection step.

8. The method of claim 1, wherein the solid carbonaceous subterranean formation is a coal bed.

9. The method of claim 6, wherein the solid carbonaceous subterranean formation is a coal bed.

10. The method of claim 1, further including the step of:

f) resuming injection of the oxygen-depleted effluent after performing step e).

11. The method of claim 10, further including the step of:

g) recovering a third methane-containing gaseous mixture from the formation during at least a portion of step f).

* * * * *

UNITED STATES PATENT AND TRADEMARK OFFICE

CERTIFICATE OF CORRECTION

PATENT NO. : 5,566,755

DATED : October 22, 1996

INVENTOR(S) : John P. Seidle, Dan Yee, Rajen Puri

It is certified that error appears in the above-identified patent and that said Letters Patent is hereby corrected as shown below:

| Col. | Line | |
|---|---|---|
| 1 | 65 | "U.S. Pat. No. 5,014,785 to Purl,et al." should --U.S. Pat. No. 5,014,785 to Puri,et al.-- |
| 2 | 44 | " "Formation paring pressure" " should read --"Formation parting pressure"-- |
| 7 | 50-51 | "inlet pressure of about to about 250 p.s.i.g.," should read --inlet pressure of about 50 to about 250 p.s.i.g.,-- |
| 11 | 53 | "N. All et al.," should read --N. Ali et al.,-- |
| 12 | 66 | "such as waxy crudes, it is believed" should read --such as waxy crudes. It is believed-- |

Signed and Sealed this

Eighteenth Day of March, 1997

Bruce Lehman

*Attest:*

BRUCE LEHMAN

*Attesting Officer*

*Commissioner of Patents and Trademarks*